US007097447B2

(12) United States Patent
Pianezze

(10) Patent No.: US 7,097,447 B2
(45) Date of Patent: Aug. 29, 2006

(54) ELECTRIC GAS LIGHTER WHICH CAN BE PRODUCED WITH ANY NUMBER OF OUTPUT TERMINALS, AND RELATIVE PRODUCTION METHOD

(75) Inventor: Daniele Pianezze, Cassano Magnago (IT)

(73) Assignee: ITW Industrial Components S.R.L., Milan (IT)

( * ) Notice: Subject to any disclaimer, the term of this patent is extended or adjusted under 35 U.S.C. 154(b) by 175 days.

(21) Appl. No.: 10/822,146

(22) Filed: Apr. 12, 2004

(65) Prior Publication Data

US 2005/0052819 A1 Mar. 10, 2005

(30) Foreign Application Priority Data

Apr. 11, 2003 (IT) ..... TO2003A0278

(51) Int. Cl.
*F23Q 7/06* (2006.01)
*H01F 27/28* (2006.01)

(52) U.S. Cl. ..... 431/258; 431/259; 336/180

(58) Field of Classification Search ..... 336/198, 336/208; 431/258–259, 254–255, 263–264
See application file for complete search history.

(56) References Cited

U.S. PATENT DOCUMENTS 4,683,518 A * 7/1987 Gwozdz ..... 361/263
5,170,768 A 12/1992 Eileraas
6,429,606 B1 * 8/2002 Aleardi et al. ..... 315/363
2002/0140538 A1 * 10/2002 Yer et al. ..... 336/198

FOREIGN PATENT DOCUMENTS

| | | |
|---|---|---|
| DE | 19508268 | 9/1996 |
| EP | 0457933 | 11/1991 |
| JP | 7307231 | 11/1995 |
| JP | 2002299137 | 10/2002 |

* cited by examiner

*Primary Examiner*—Anh Mai
(74) *Attorney, Agent, or Firm*—Lowe Hauptman & Berner, LLP

(57) ABSTRACT

An electric gas lighter for generating sparks at one or more burners of a cooking range, and including a transformer having a primary winding, and a secondary winding divided into a number of coils, each having output terminals, and which are wound on respective axially adjacent portions of a substantially cylindrically symmetrical drum forming part of a supporting member made of insulating material and formed in one piece with supports projecting tangentially with respect to the drum and each supporting a respective terminal defined by a blade contact; the coils are connected electrically to one another in series to form one secondary winding, which has been obtained by winding continuously, i.e. without making cuts, an insulated electrically conducting wire onto the drum to form the coils; the wire being wound alternately onto the drum in an opposite direction for each coil; and the winding direction being inverted upon the wire engaging each terminal located axially between two adjacent coils.

15 Claims, 5 Drawing Sheets

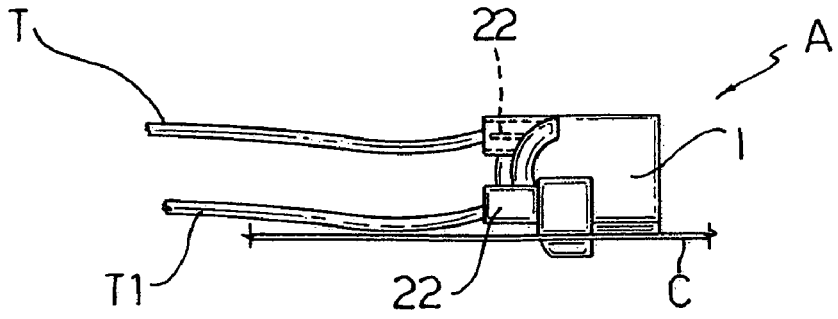
Fig.9 - prior art -
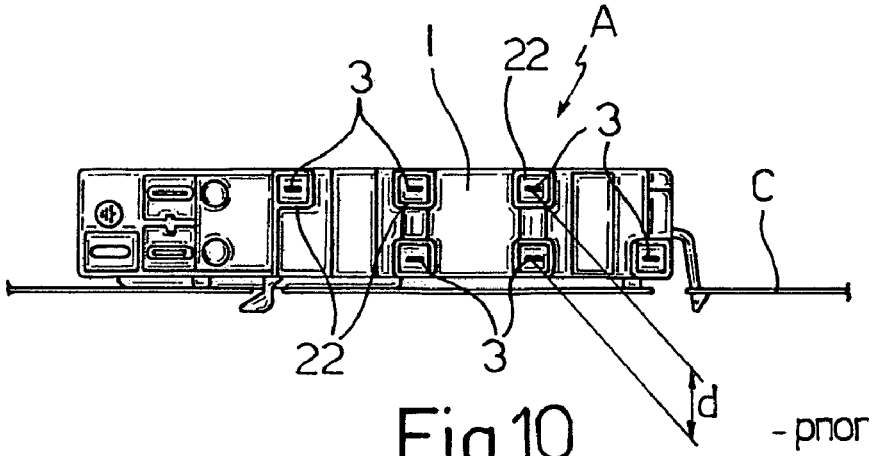
Fig.10 - prior art -
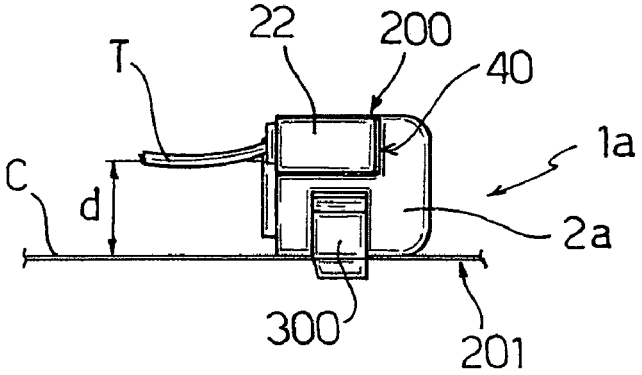
Fig.11

ELECTRIC GAS LIGHTER WHICH CAN BE PRODUCED WITH ANY NUMBER OF OUTPUT TERMINALS, AND RELATIVE PRODUCTION METHOD

The present invention relates to an electric gas lighter which may be used in a cooking range of a gas cooker for generating sparks at one or more burners on the range.

BACKGROUND OF THE INVENTION

Currently marketed lighters all have an even number of output terminals, each for supplying high voltage to a spark plug for lighting a burner on a cooking range. In the case of a cooking range with an odd number of burners, therefore, a lighter with the nearest number of even terminals must be used, and the extra terminal must be earthed by an earth wire to neutralize its action without impairing operation of the lighter.

This is due to known lighters comprising as the main component a transformer, the secondary winding of which is defined by a number of electrically separate coils, each supplying voltage at the opposite ends to two respective terminals.

When assembling the cooking range, an additional earth wire (in addition to the one prescribed by regulations) must therefore be used, thus increasing assembly cost, time, and difficulty (in view of the normally confined space involved). A certain amount of energy is also wasted by being earthed by a wire or various connections. This continuity between the secondary winding wire and earth may even prove damaging in the event of a loss of insulation between the primary and secondary wires (e.g. as a result of a damaged winding or insulation).

Generators with odd numbers of output terminals are also marketed, though, in actual fact, these are identical to the former, except that the extra output terminal is earthed by internal connection to the earth on the printed circuit of the lighter, or to the earth contact on the casing. The problem of energy waste therefore remains unsolved, and the advantage in terms of assembly is normally achieved at the expense of higher production cost.

SUMMARY OF THE INVENTION

It is an object of the present invention to provide a gas lighter designed to eliminate the aforementioned drawbacks, and which, in particular, is compact, is cheap and easy to produce, and can be produced, using the same technology, with an odd or even number of output terminals, thus eliminating the need for an additional earth wire in the case of cooking ranges with an odd number of burners.

At the same time, it is also an object of the invention to provide a gas lighter designed to eliminate the drawbacks associated with known gas lighters and relating to possible spark generation between the output terminals, or rather the wires connected to the output terminals, and the cooking range.

According to the present invention, there is provided an electric gas lighter as claimed in Claim 1.

More specifically, as opposed to being separate, the coils defining the secondary winding of the transformer are connected electrically in series to form one secondary winding, which is obtained by continuously winding, without making cuts, an insulated electrically conducting wire onto a drum of an insulating supporting member to form said coils; the wire being wound alternately onto the drum in an opposite direction for each coil; and the winding direction of the wire being inverted upon the wire engaging a respective common terminal placed between two adjacent coils.

An even number of coils therefore always has an odd number of output terminals, and, to form an even number of output terminals, the lighter need simply be made with an odd number of coils, i.e. one coil more (or less) than the same model having an odd number of terminals.

Consequently, not only does the user of the lighter no longer "waste" an output terminal, thus increasing cost, but the maker of the lighter also benefits in terms of product standardization. For example, the drum need simply be made with an odd (m) number of winding seats, so that it can receive a maximum odd number of coils (and therefore an even number of outputs), and, in the case of a lighter for an odd number of burners, one of the seats need simply be left vacant, with no coil, so that the same structure provides for obtaining a lighter for an even or odd number of burners, as required.

The present invention also relates to a method of producing such a lighter, as claimed in claim 11.

According to a further preferred aspect of the invention, all the high-voltage output terminals of the lighter are arranged side by side along a same first side of a coil casing; the output terminals are carried by respective supports formed in one piece with the drum of said insulating supporting member, projecting tangentially with respect to the drum, and arranged side by side along a same side of the drum; and said first side of the coil casing supporting all the output terminals of the lighter side by side is opposite a second side of the casing located on the same side as click-on fastening means carried integrally by the casing and for clicking the casing onto an electrically conducting support of an electric household appliance, such as a cooking range.

BRIEF DESCRIPTION OF THE DRAWINGS

A non-limiting embodiment of the present invention will be described by way of example with reference to the accompanying drawings, in which:

FIGS. 9 and 10 show a front and longitudinal view respectively of the way in which a conventional lighter is fitted to a cooking range;

FIGS. 11 and 12 show the same views as in FIGS. 9 and 10, but of the way in which a variation of the lighter according to the invention is fitted to a cooking range;

DETAILED DESCRIPTION OF THE INVENTION

Figure 8:
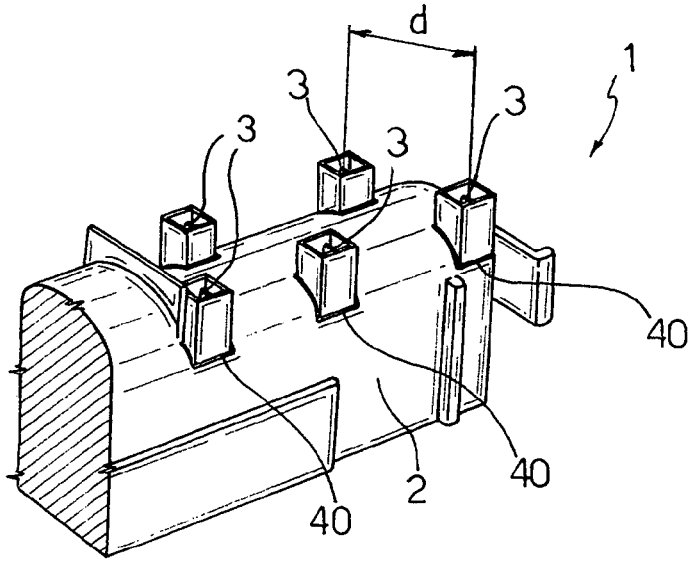
FIG. 8 shows, with parts removed for clarity, a smaller-scale, three-quarter top view in perspective of the lighter according to the invention.

As shown in the above drawings, an electric gas lighter, indicated as a whole by reference number 1 (FIG. 8), comprises a casing 2 made of electrically insulating material, e.g. molded from synthetic plastic material, and housing a number of known circuit elements (not shown for the sake of simplicity), and a transformer (not shown in FIG. 8) for supplying high voltage to a predetermined number of terminals 3 fitted to the outside of casing 2 and for supplying said high voltage, for example, to respective spark plugs of respective burners of a cooking range, all of which is known and therefore not shown for the sake of simplicity.

Figure 1:
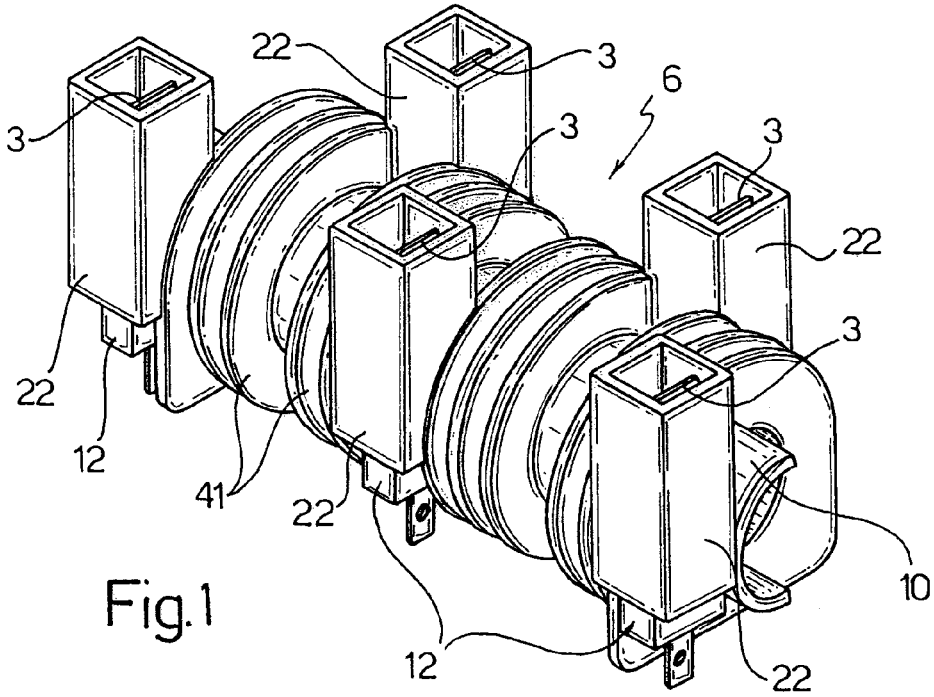
FIG. 1 shows a three-quarter top view in perspective of a supporting member made of plastic and constituting a main member of the lighter according to the invention.
Figure 2:
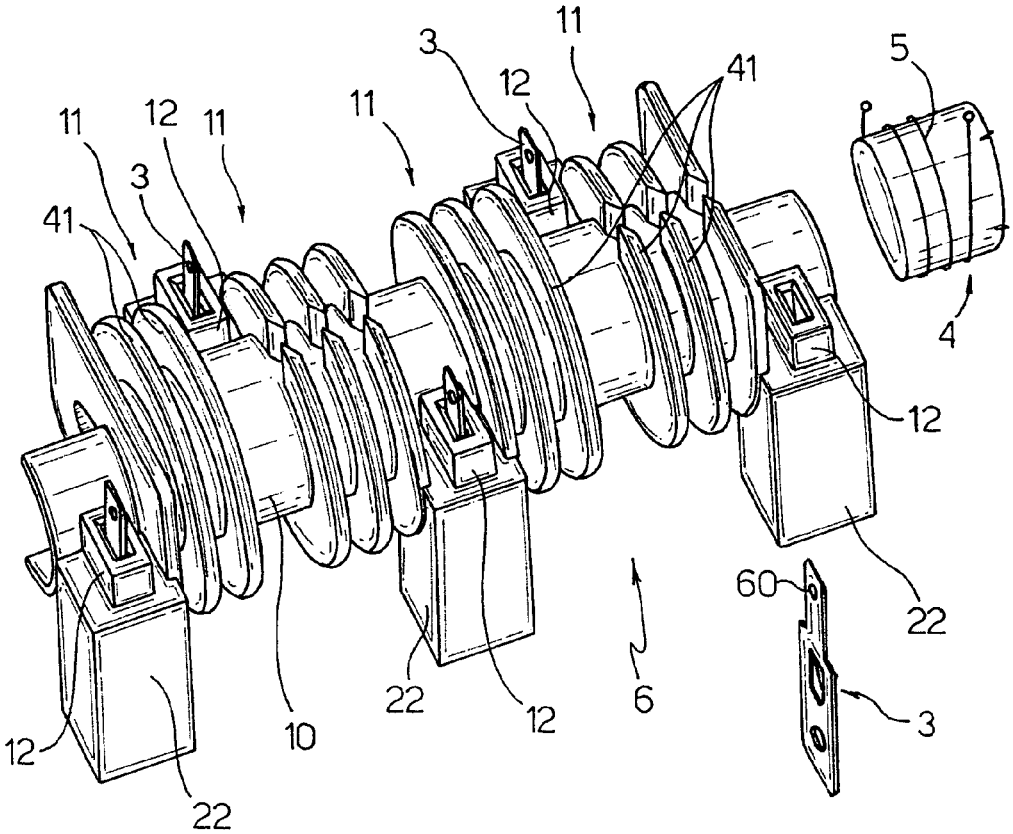
FIG. 2 shows a three-quarter bottom view in perspective of the FIG. 1 supporting member.
Figure 3:
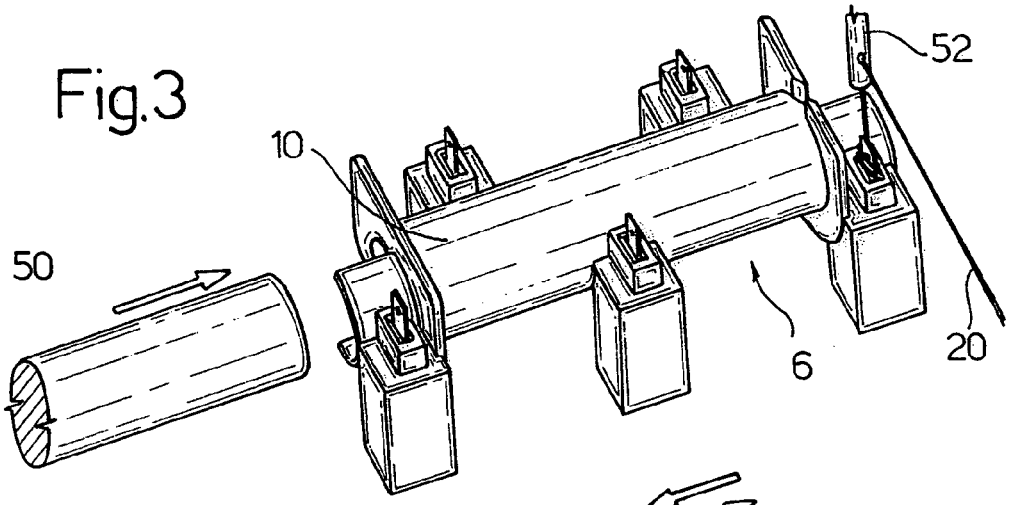
FIGS. 3 to 7 show, schematically, successive steps in the manufacture of the lighter according to the invention.
Figure 4:
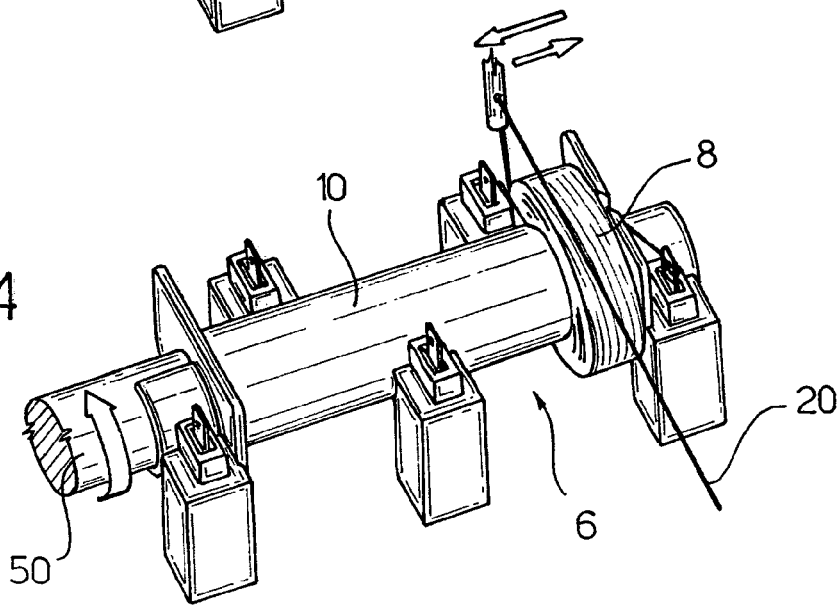
Figure 6:
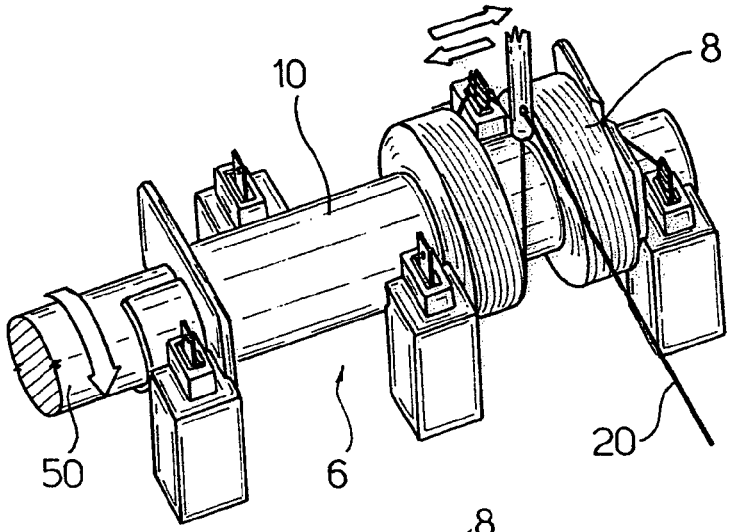
Figure 7:
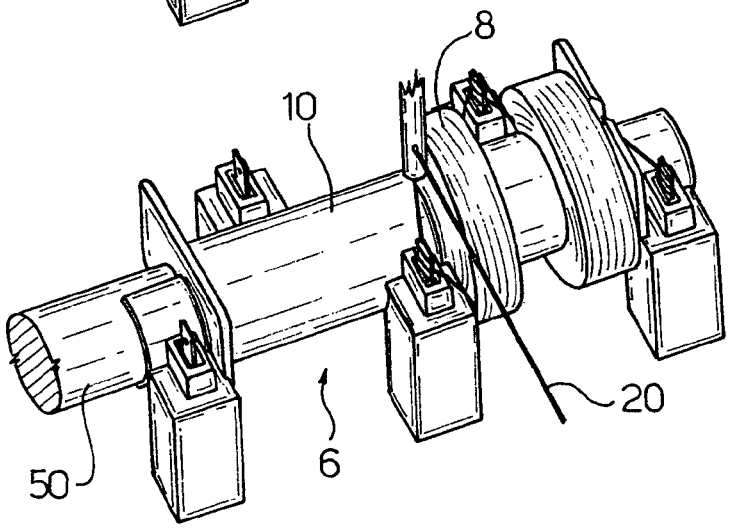

The transformer of lighter 1 (FIGS. 1 and 2) comprises a primary winding 4 wound about a cylindrical core 5 of ferrite (or other suitable material); and a supporting member 6 also made of electrically insulating material, e.g. of the same material as casing 2 (e.g. molded from polyamide), and which houses winding 4 with the relative ferrite core, and supports on the outside, i.e. in electrically insulated manner, a secondary winding comprising a number of coils 8, of which only two are shown schematically in FIGS. 6 and 7.

Terminals 3 are connected electrically, as will be seen, to the secondary winding (not shown as a whole for the sake of simplicity), and are fitted integrally in known manner to supporting member 6.

More specifically, supporting member 6 comprises a tubular, substantially cylindrically symmetrical drum 10 for housing core 5 with winding 4; coils 8 are supported on the outside of drum 10, and are wound about respective axially adjacent portions of drum 10 defined by respective winding seats 11 (FIGS. 1 and 2) of substantially known form; and supports 12 project tangentially from and on the outside of drum 10, are formed integrally in one piece with and of the same material as drum 10, and each support a respective terminal 3.

Figure 5:
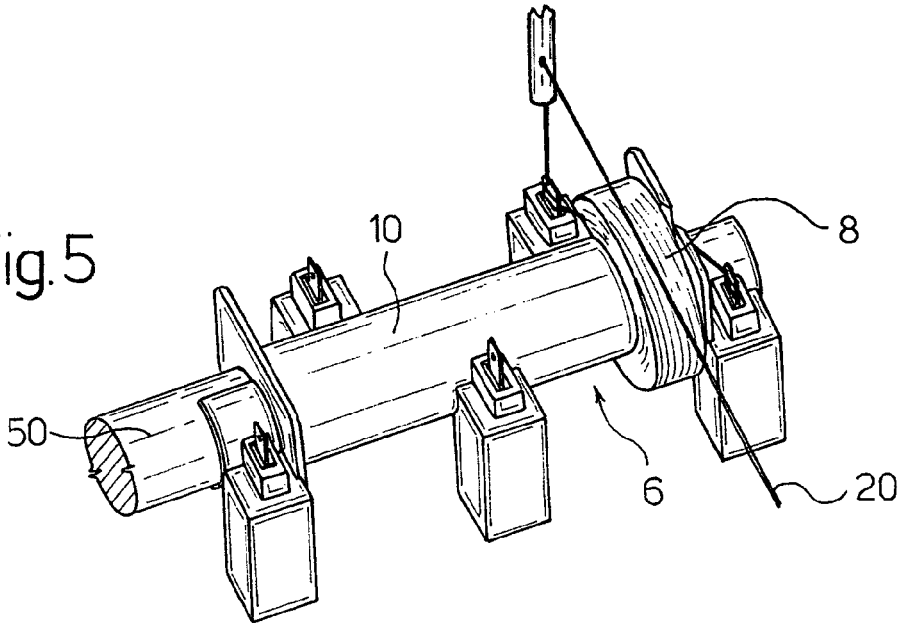

According to the main aspect of the invention, coils 8 are connected electrically to one another in series to form one single secondary winding, which is obtained by continuously winding without making cuts a known electrically conducting wire 20 (FIGS. 3–7), having an insulating coating (e.g. of paint), onto drum 10 to form coils 8. Wire 20 is wound alternately onto drum 10 in an opposite direction for each coil 8, and the winding direction of wire 20 is inverted upon wire 20 engaging a common terminal 3 placed between two adjacent coils 8 (FIGS. 5, 6).

Each terminal 3 (FIG. 2) is defined by a blade contact, e.g. faston type, for supplying high voltage in known manner to a respective burner. According to the invention, and as explained in detail later on, lighter 1 comprises a number (n) of coils 8, and a number (n+1) of terminals 3, where (n) is any whole number (integer) greater than 2.

Drum 10 preferably comprises an odd number (m) of winding seats 11, each for receiving wire 20 wound in a predetermined direction to form a respective coil 8; and a number (m+1) of supports 12 for terminals 3.

According to a further aspect of the invention, tubular drum 10 comprises, integral in one piece with each support 12, a prismatic tubular member 22 for housing a respective blade contact (terminal) 3 carried integrally in known manner, e.g. clicked onto, respective support 12, so as to define, with terminal 3, a standard electric connector.

In combination with the above characteristic, casing 2 (FIG. 8)—which, as stated, houses supporting member 6 with wire 20 wound about drum 10 to form coils 8 on the outside of drum 10, and with primary winding 4 inserted coaxially inside drum 10—has a number of openings 40 through which prismatic tubular members 22 are inserted.

On the outside and at each coil 8, tubular drum 10 (FIG. 2) is preferably formed in one piece with a number of semiannular partitions 41 for dividing each coil 8 in known manner into a number of electrically separate sections.

With reference to FIGS. 3–7, lighter 1 according to the invention as described above is produced using a method comprising the steps of:

(a) molding casing 2 and supporting member 6 from synthetic plastic material;

(b) assembling a predetermined number of terminals 3 (in interference, click-on, or any other manner) to supports 12 and inside members 22, possibly leaving one support 12 with no terminal 3;

(c) assembling supporting member 6, by means of tubular drum 10, to a rotary spindle 50; this may also be movable axially to engage/release drum 10 (FIG. 3); or in case of a non-axially-moving rotary spindle is used a loading/unloading spindle (known and not shown for the sake of simplicity) is also used;

(d) securing conducting wire 20, e.g. carried in a magazine not shown, to a first terminal 3 at a first end of supporting member 6, e.g. using a known wire handling and tensioning device 52, and then (FIG. 4) winding wire 20 onto tubular drum 10 to form a first coil 8 adjacent to said terminal 3 engaged by wire 20, by rotating the spindle in a given first, e.g. anticlockwise, direction;

(e) stopping spindle 50, securing wire 20 (FIG. 5), without cutting it, to a second terminal 3 immediately adjacent to the coil 8 just formed, and winding wire 20 onto tubular drum 10 to form a second coil 8, axially adjacent to and connected electrically in series to the first, by rotating spindle 50 in a given second direction opposite the first, e.g. clockwise (FIG. 6);

(f) repeating step (e) n times (depending on the number of seats 11 on member 6) to form on tubular drum 10 a given number of coils 8 all connected electrically in series to one another, and with terminals 3 interposed between common adjacent coils 8;

(g) assembling core 5, complete with winding 4, inside tubular drum 10 to form an assembly constituting a transformer; and (h) fitting said assembly inside casing 2, so that terminals 3 pass through and project from casing 2—in the example shown, by inserting members 22 inside openings 40. Wire 20 may be connected to terminals 3, as shown schematically, by simply inserting wire 20 inside holes 60 (FIG. 2) in terminals 3, and soldering later.

A subunit, defined by said assembly comprising the two, primary and secondary, windings of the transformer with supporting member 6 and terminals 3, may be preassembled as described above, and then assembled automatically inside casing 2, using members 22 and openings 40 as assembly guides.

The same lighter 1 with an odd number m of seats 11 may therefore be used to light both an even number m+1 of burners (equal to the number of terminals 3 when all the seats are used), and an odd number m of burners by simply leaving one of seats 11 and a respective adjacent support 12 free of wire 20, i.e. by forming one coil 8 less than the number permitted by the structure of supporting member 6, thus enabling considerable scale economy in the manufacture of the molded plastic parts.

By way of comparison with the solution according to the invention, FIGS. 9 and 10 show a conventional lighter, indicated as a whole by A, comprising a casing I, from which project prismatic members 22 housing respective terminals 3. Lighter A is shown fitted for use to a known cooking range C, with terminals 3 (FIG. 9) engaged by respective high-voltage output wires T connected in known manner (not shown) to respective electrodes close to the burners of cooking range C to be lit. Terminals 3 along the centreline of casing I are obviously arranged in pairs in the same axial positions, project from opposite sides of casing I, and are therefore stacked on cooking range C. Since, for electric insulation purposes, a given distance "d" must be maintained between terminals 3, this distance, in the case of lighter A, is measured vertically, i.e. perpendicular to cooking range C.

Conversely, in the case of lighter 1 described, by virtue of the way in which coils 8 are wound, terminals 3 (with relative supports 12 and tubular members 22) are never paired in the same axial position on opposite sides of the casing, but, as shown clearly in FIGS. 1–8, are located alternately, in an axial direction, on opposite sides of casing 2. Consequently, distance "d" is measured diagonally (FIG. 8), so that casing 2 can be made more compact vertically than casing I, which is a fairly desirable market characteristic.

According to a no less important aspect of the invention, the vertical size of the lighter casing can be further reduced.

Figure 12:
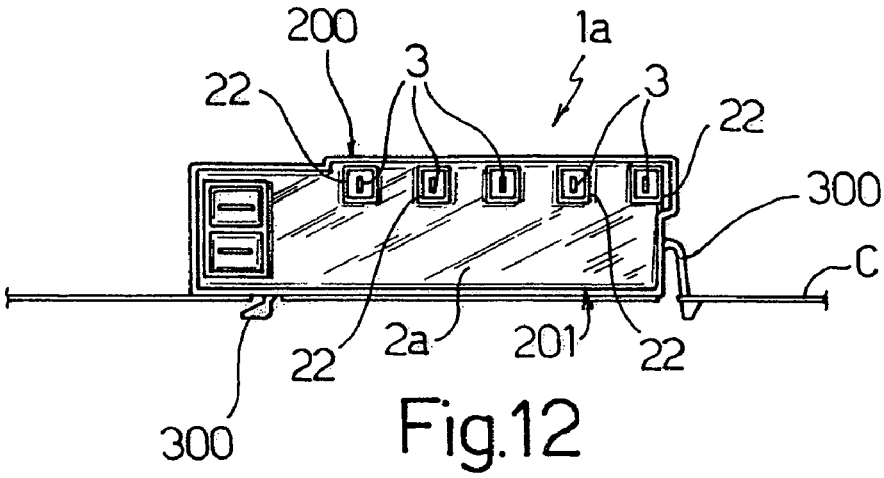
Figure 13:
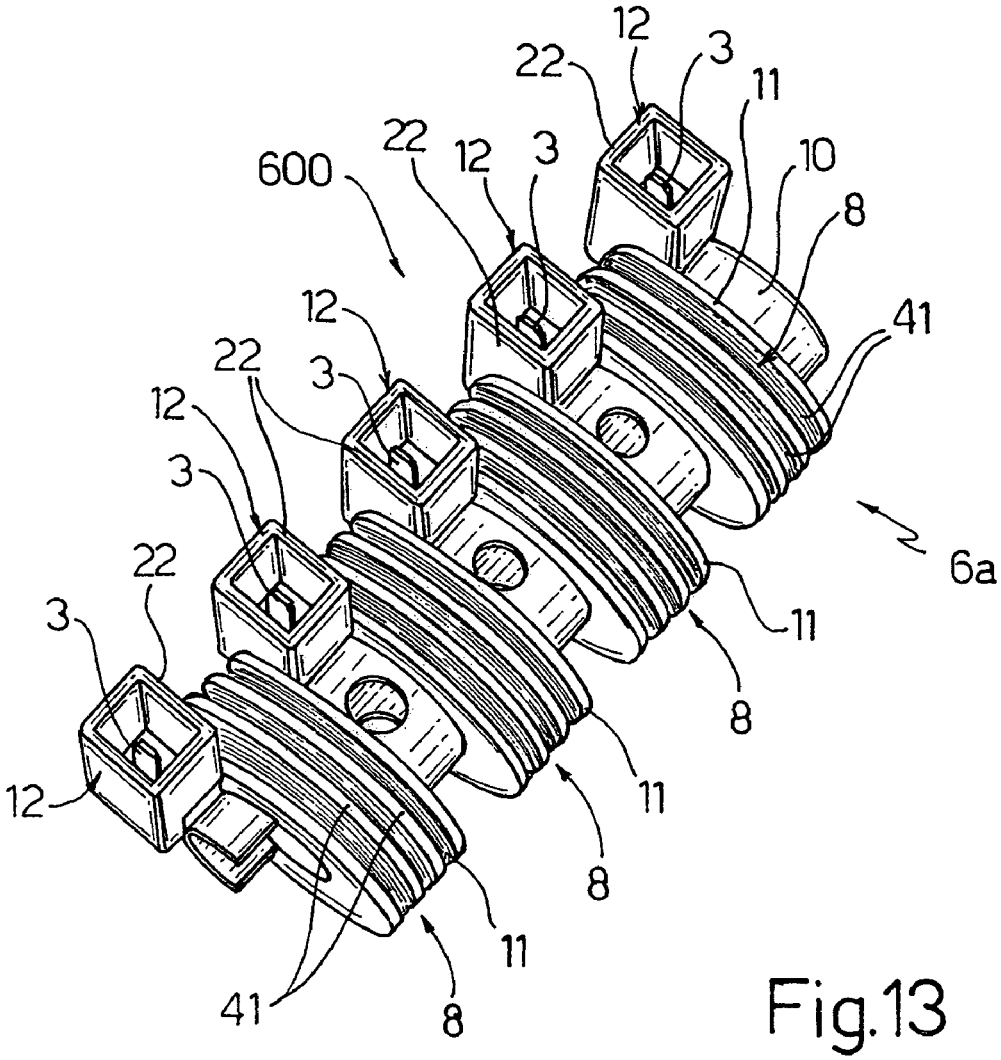
FIG. 13 shows a three-quarter top view in perspective of a supporting member made of plastic and constituting a main member of the FIG. 11 and 12 lighter, and rotated 90° with respect to the corresponding view of the corresponding main member of the FIG. 8 lighter in FIG. 1.

FIGS. 11 to 13, in fact, show a preferred variation 1*a* of lighter 1 according to the invention, in which details similar to or identical with those already described are indicated for the sake of simplicity using the same reference numbers.

Lighter 1*a* has all the high-voltage output terminals 3 arranged side by side along a same first side 200 of a casing 2*a* housing coils 8; output terminals 3 are carried by respective supports 12 formed in one piece with the drum 10 of an insulating supporting member 6*a*; and supporting member 6*a* is substantially identical with supporting member 6 described above, except that supports 12 are formed in one piece with it so as to project tangentially with respect to drum 10, and are all located side by side along a same side 600 of drum 10.

The first side 200 of casing 2*a* of coils 8, on which output terminals 3 of lighter 1*a* are all arranged side by side, is selected so as to be opposite a second side 201 of casing 2*a*, located on the same side as known means 300 integral with casing 2*a* and defined, for example, by elastic teeth for clicking casing 2*a* onto an electrically conducting support of an electric household appliance—in this case, onto cooking range C.

Consequently, terminals 3 with relative supports 12 and prismatic tubular members 22 are all located, in use, on the opposite side to cooking range C (FIGS. 11, 12).

This provides for further reducing the vertical size of the lighter according to the invention, and, above all, prevents some of the wires T from having to be fitted adjacent to cooking range C, as in known lighters (see wire T1 in FIG. 9). This not only greatly simplifies the wiring of lighter 1*a*, but, above all, safeguards against sparks being generated between wires T and cooking range C, on account of wires T all being located at least distance "d" from cooking range C.

The invention claimed is:

1. An electric gas lighter for generating sparks at one or more burners of a cooking range, comprising:

a transformer having a primary winding, and a secondary winding divided into a number of coils and having a predetermined number of output terminals; the coils being wound on respectively axially adjacent portions of a substantially cylindrically symmetrical, tubular drum forming part of a supporting member made of electrically insulating material and formed in one piece with supports projecting tangentially with respect to the drum and each supporting a respective said terminal; wherein the coils are connected electrically to one another in series to form said secondary winding, which has been obtained by continuously winding without making cuts an insulated electrically conducting wire onto the drum to form said coils; the wire being wound alternately onto the drum in an opposite direction for each coil; and the winding direction of the wire being inverted upon the wire engaging a respective common terminal between two adjacent coils.

2. A gas lighter as claimed in claim 1, wherein, on the outside, at each said coil, said tubular drum is formed in one piece with a number of semiannular partitions for dividing each coil into a number of electrically separate sections.

3. A gas lighter as claimed in claim 1, wherein said coils are n in number and the relationship between said coils and said terminals is n:(n+1), where n is any integer greater than 2.

4. A gas lighter as claimed in claim 1, wherein each said terminal is defined by a blade contact for supplying a voltage, in use, to a respective burner; the secondary winding comprising a number (n) of coils and a number (n+1) of terminals, where (n) is any integer greater than 2.

5. A gas lighter as claimed in claim 4, wherein said drum has an odd number (m) of winding seats, each for receiving a respective said coil, and a number (m+1) of said supports for the terminals, one of said seats and a respective adjacent support not being engaged by said wire.

6. A gas lighter as claimed in claim 4, wherein said tubular drum has a prismatic tubular member formed in one piece with each said support and for housing a said blade contact fitted to and defining an electric connector with the respective support.

7. A gas lighter as claimed in claim 6, further comprising an outer casing made of electrically insulating material and housing said supporting member, wherein said wire is wound on the drum to form said coils on the outside of the drum, and said primary winding is inserted coaxially inside said tubular drum; said casing having a number of openings through which said prismatic tubular members formed in one piece with the supports of the terminals are inserted, so that a subunit, defined by the, primary and secondary, windings with the respective supporting member and terminals can be preassembled and then fitted inside the casing.

8. A gas lighter as claimed in claim 7, wherein said casing and said supporting member, with the respective tubular drum, respective supports, and respective prismatic tubular members for housing the terminals, are molded from synthetic plastic material.

9. A gas lighter as claimed in claim 6, wherein said terminals are all located side by side along a same first side of said casing; said terminals being carried by respective supports (12), which are formed in one piece with said drum of the insulating said supporting member, project tangentially with respect to the drum, and are all arranged side by side along a same side of the drum.

10. A gas lighter as claimed in claim 9, wherein said first side of the casing, on which the terminals are all arranged side by side, is selected so as to be opposite a second side of the casing located on the same side as a fastening element integral with the casing and for clicking the casing onto an electrically conducting support of an electric household appliance.

11. A gas lighter as claimed in claim 6, wherein said terminals, with the relative supports and prismatic tubular housing members, are located alternately, in an axial direction, on opposite sides of said casing.

12. An electric gas lighter, comprising:

a transformer including:

a primary winding;

a secondary winding, wherein the secondary winding is divided into a number of coils; and a predetermined number of output terminals;

wherein the coils are wound on axially adjacent portions of a tubular drum forming part of a supporting member made of electrically insulating material and including supports projecting from the drum and each supporting a respective said terminal; wherein the coils are electrically connected to one another in series to form said secondary winding, the secondary winding comprising an electrically conducting wire continuously wound onto the drum, wherein the wire is wound alternately around the drum in an opposite direction for each coil and the winding direction of the wire is inverted upon the wire engaging a respective common terminal between two adjacent coils.

13. A method of producing a gas lighter with any number of output terminals, comprising the steps of:

(a) molding from synthetic plastic material a supporting member comprising a tubular drum and a number of supports for respective electric terminals;

(b) assembling a predetermined number of terminals to the supports;

(c) assembling the supporting member, by means of said tubular drum, to a rotary spindle;

(d) securing an insulated electrically conducting wire to a first terminal at a first end of the supporting member, and winding said wire onto the tubular drum to form a first coil by rotating the spindle in a given first direction;

(e) stopping the spindle, securing the wire to a second terminal adjacent to the coil just formed, and winding said wire onto the tubular drum to form a second coil, axially adjacent to the first coil, by rotating the spindle in a given second direction opposite the first direction;

(f) repeating step (e) n times to form on the tubular drum coils all connected electrically in series to one another, and with the terminals interposed between adjacent coils;

(g) assembling inside the tubular drum a core made of ferrite and having an electric winding, to form an assembly constituting a transformer; and (h) fitting said assembly inside a casing, so that said terminals pass through and project from the casing.

14. A method as claimed in claim 13, wherein step (b) includes leaving one support with no terminal.

15. A method as claimed in claim 13, wherein step (e) is performed without cutting the wire.

* * * * *